US009301629B2

(12) United States Patent
Brown

(10) Patent No.: US 9,301,629 B2
(45) Date of Patent: Apr. 5, 2016

(54) SLEEPING BAG WITH DETACHABLE BOOK

(76) Inventor: Simcha Brown, Cedarhurst, NY (US)

( * ) Notice: Subject to any disclaimer, the term of this patent is extended or adjusted under 35 U.S.C. 154(b) by 219 days.

(21) Appl. No.: 13/441,279

(22) Filed: Apr. 6, 2012

(65) Prior Publication Data

US 2012/0255125 A1 Oct. 11, 2012

Related U.S. Application Data

(60) Provisional application No. 61/473,371, filed on Apr. 8, 2011.

(51) Int. Cl.
*A47G 9/08* (2006.01)

(52) U.S. Cl.
CPC ..... *A47G 9/08* (2013.01)

(58) Field of Classification Search
CPC ..... A47G 9/08; A47G 9/083; A47G 9/086; A47G 9/06
USPC ..... 5/413 R, 413 AM, 417, 420, 482, 485, 5/494, 502, 904
See application file for complete search history.

(56) References Cited

U.S. PATENT DOCUMENTS

| | | | | | |
|---|---|---|---|---|---|
| 2,594,438 | A * | 4/1952 | Howe | 5/413 R |
| 3,584,323 | A * | 6/1971 | Worley | 5/413 R |
| 4,087,874 | A * | 5/1978 | Callaway et al. | 5/413 R |
| 4,513,461 | A * | 4/1985 | Tardivel | 5/413 R |
| 4,768,245 | A * | 9/1988 | Dutton | 5/636 |
| 4,874,340 | A * | 10/1989 | Smallwood | 446/28 |
| 5,005,235 | A * | 4/1991 | Huang | 5/413 R |
| 5,343,578 | A * | 9/1994 | Kettenhofen | 5/413 R |
| 5,640,725 | A * | 6/1997 | Ando et al. | 5/413 AM |
| 5,706,532 | A * | 1/1998 | Kettenhofen | 5/413 R |
| 6,859,960 | B1 * | 3/2005 | Jerome | 5/413 R |
| 7,051,387 | B1 * | 5/2006 | Yoder et al. | 5/413 R |
| 2002/0078501 | A1 * | 6/2002 | Lamke | 5/413 AM |
| 2003/0182724 | A1 * | 10/2003 | Zheng | 5/413 R |
| 2005/0076438 | A1 * | 4/2005 | Laguatan et al. | 5/424 |
| 2007/0295773 | A1 * | 12/2007 | Wegenhoft | 224/576 |
| 2008/0178386 | A1 * | 7/2008 | Thompson | 5/485 |
| 2008/0256705 | A1 * | 10/2008 | Maguire | 5/413 R |

* cited by examiner

*Primary Examiner* — Nicholas Polito
(74) *Attorney, Agent, or Firm* — Eric Kelly

(57) ABSTRACT

Disclosed herein is a sleeping bag having a removable book located in a cavity in the top cover of the sleeping bag. The book is accessed by unzipping the opening of the cavity. The book is removably attached to the interior of the cavity using fastening means such as a hook and loop connection.

18 Claims, 13 Drawing Sheets

SLEEPING BAG WITH DETACHABLE BOOK

CROSS-REFERENCE TO RELATED APPLICATIONS

This application claims priority under 35 U.S.C. §119(e) to U.S. Provisional Application Ser. No. 61/473,371, filed Apr. 8, 2011.

FIELD OF THE INVENTION

The present invention relates generally to the field of sleeping bags. More particularly, the present invention relates to sleeping bags having a cavity formed therein for storing a removable book.

BACKGROUND

Sleeping bags are well known. Typically, sleeping bags are formed of a body having a bottom cover attached to a top cover along a side. Two of the three other sides of the top cover and bottom cover can be attached to each other by a zipper, thereby allowing a user easy access to the interior of the sleeping bag. Some sleeping bags also have an integral pillow attached to the top or bottom cover of the sleeping bag.

However, most sleeping bags are simply utilitarian and do not provide any entertainment for children. Therefore, a need exists for a sleeping bag capable of providing entertainment to a child.

SUMMARY OF THE INVENTION

The present invention provides a sleeping bag formed from a bottom cover member and a top cover member attached along one side. The top cover member and bottom cover can be formed from one integral member that is folded to define the top cover member and the bottom cover member or from two separate members joined at a seam. The top cover member and the bottom cover member are removably attached along two other sides via a zippered connection.

The top cover member has a cavity with an opening. A book is located in the cavity and is removably attached to the interior of the cavity. The opening of the cavity may be sealed by a zippered connection to secure the book within the cavity. Preferably, the book is able to be read by the child while in the sleeping bag.

In some embodiments, the book is removably attached to the interior of the cavity using fastening means such as a hook and loop connection (e.g., Velcro™) or a zippered connection. The book is preferably a children's book for providing entertainment to a child. Because the books are removable, they can easily be changed if a child is no longer entertained by the book currently in the sleeping bag.

The sleeping bag may also contain a pillow member attached to the top cover member or the bottom cover member of the sleeping bag. In some embodiments, the pillow member is removably attached to the sleeping bag (e.g., via a zippered connection).

The top cover member, the bottom cover member, and/or the pillow member may contain a removable foam insert. This allows the foam insert to be replaced and washed. In some embodiments, the foam insert has a waterproof covering so that it can easily be cleaned.

The book can be constructed of any known pliable materials such as cloth, plastic, or rubber. The material must be pliable so that the book can be rolled up along with the sleeping bag.

The sleeping bag may further comprise a carrying member adapted to store the sleeping bag when it is rolled up. In some embodiments, the carrying member has a handle or shoulder straps for easy transport of the carrying member.

In a further embodiment, the interior of the cavity has a sealable (e.g., with a zipper) pocket adapted to store an audio device, such as an MP3 player or a CD player, that contains a recording of the book. Such an audio device is useful for children who have not yet learned to read or have difficulty reading. In some embodiments, the content for the device can be obtained from the Internet.

BRIEF DESCRIPTION OF THE DRAWINGS

The present invention will now be described by way of example only with reference to the attached drawings, in which.

DETAILED DESCRIPTION

Figure 1:
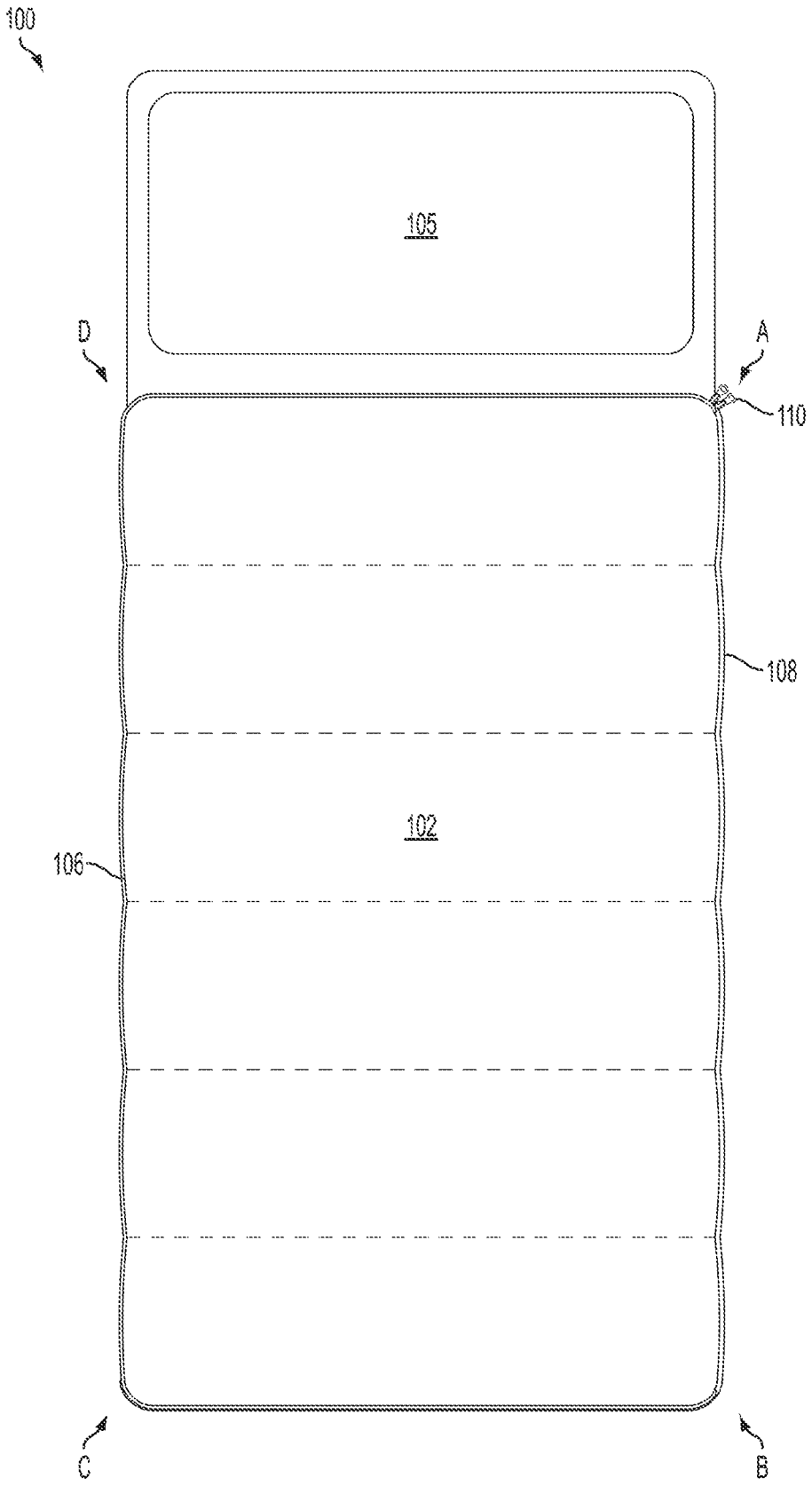
FIG. 1 depicts a view of the sleeping in a closed position.

With reference to FIG. 1, depicted is a top view of sleeping bag 100. Generally, sleeping bag 100 comprises top cover member 102, bottom cover member 104 (not shown), and pillow member 105. In some embodiments, pillow member 105 may be removably attached to sleeping bag 100 (e.g., via a zippered connection).

Top cover member 102 and bottom cover member 104 can be formed of a single member or formed from two members and joined at seam 106. Zippered connection 108 extends around the periphery of two sides of top cover member 102 and bottom cover member 104 allowing them to be removably attached to each other using zipper 110, thereby allowing a user easy access to the interior of sleeping bag 100. For example, a user can open sleeping bag 100 by drawing zipper 110 from point A, to point B, and then to point C. The portion of sleeping bag between points C and D remains as a closed hinge so that top cover member 102 can be pivoted to an open position. Sleeping bag 100 can be closed by advancing the zipper from point C, to point B, and then to point A.

Figure 2:
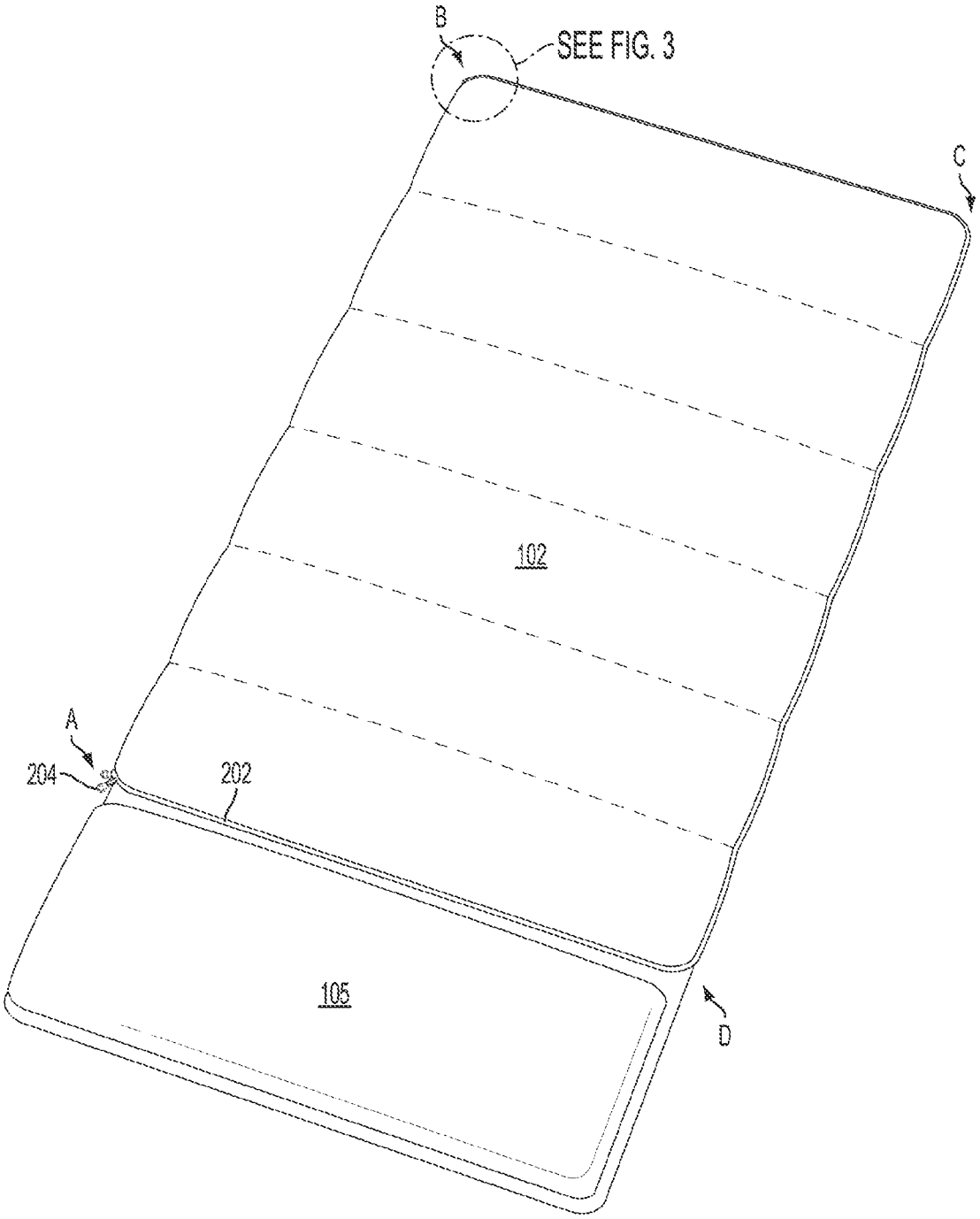
FIG. 2 depicts an alternate view of the sleeping bag of FIG. 1.
Figure 3:
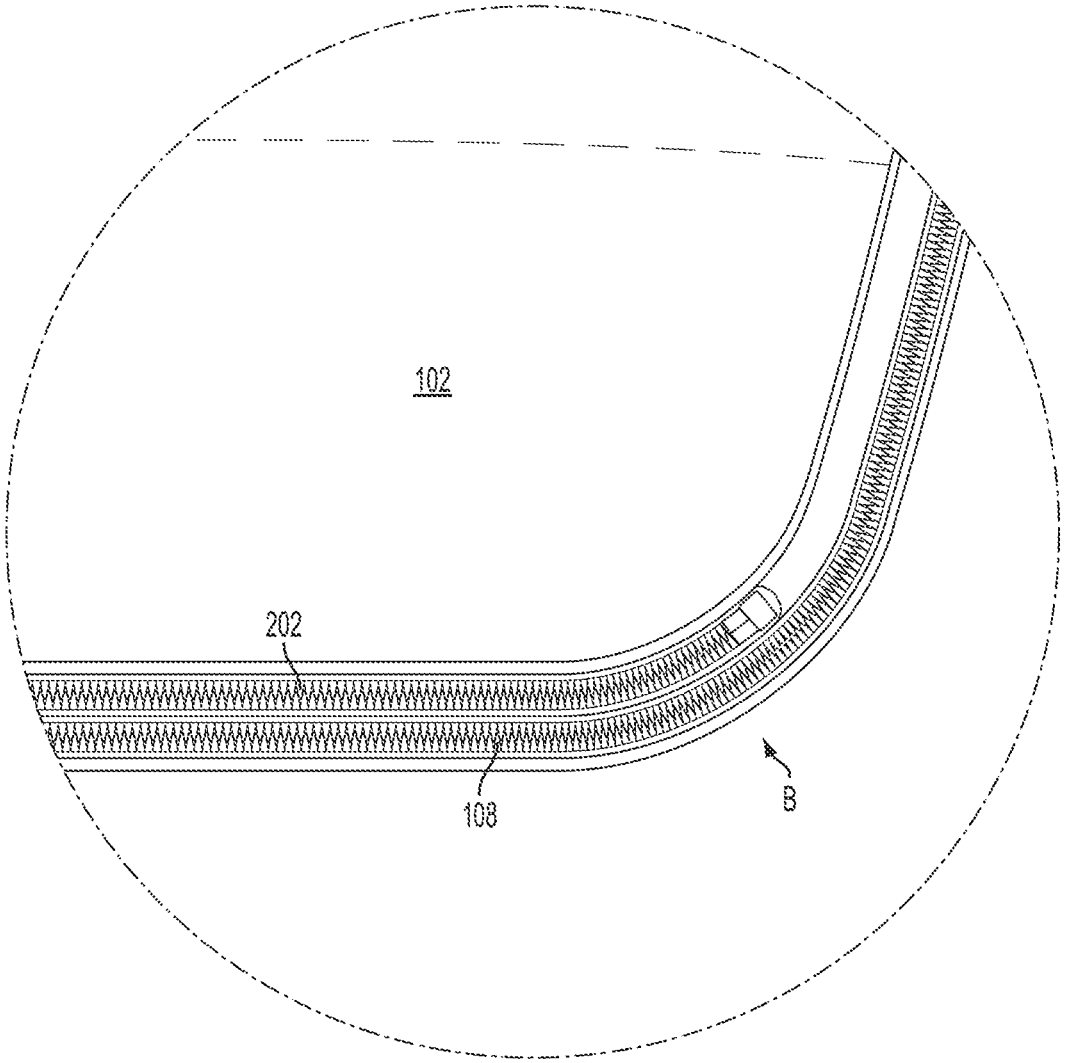
FIG. 3 depicts an enhanced view of corner B of the sleeping bag of FIG. 1 showing the zipper detail.
Figure 4:
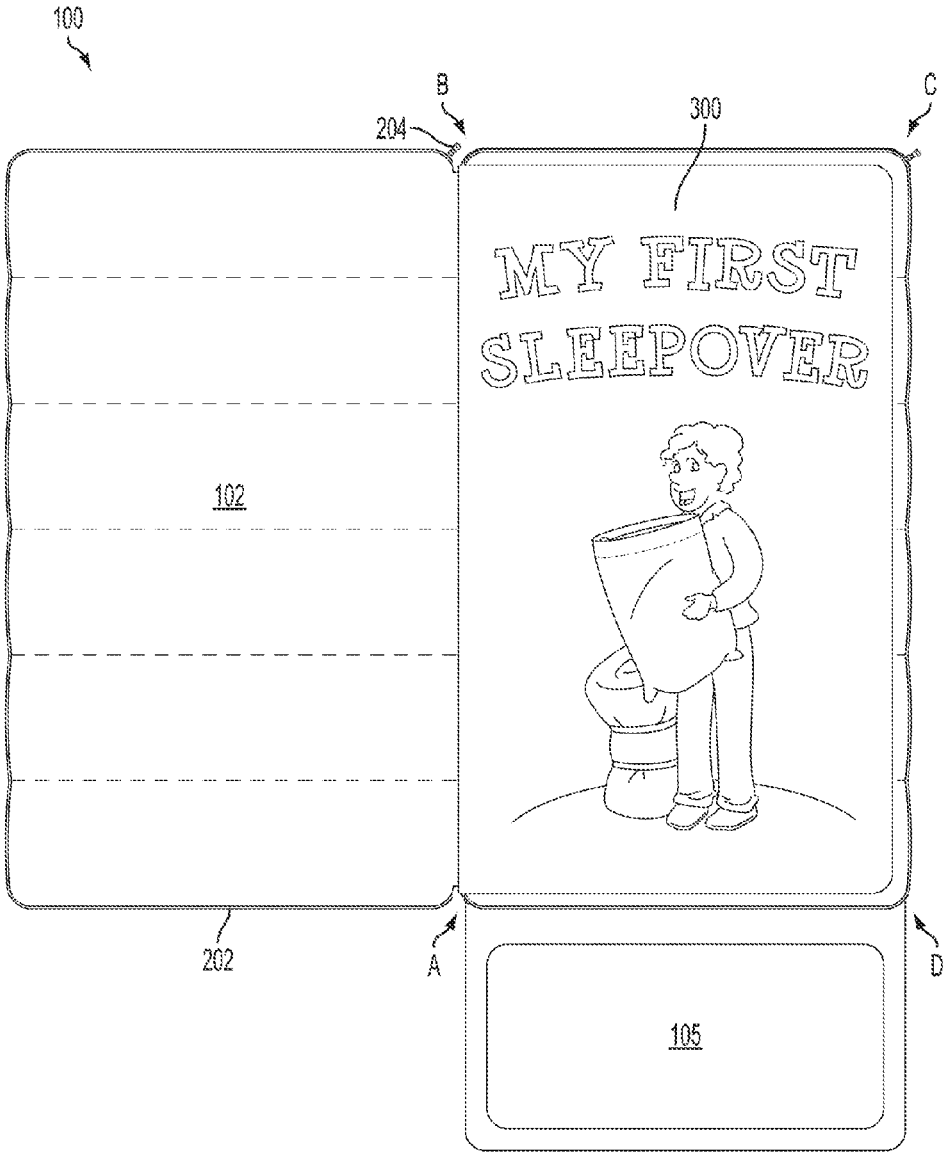
FIG. 4 depicts a view of the sleeping bag of FIG. 1 showing the top cover member opened to expose the book.

FIG. 2 depicts an alternate view of sleeping bag 100 in its closed position. Should the user want to read the book contained in top cover member 102, a second zippered connection 202 is provided around the periphery of top cover member 102 defining a cavity therein. FIG. 3 depicts an enlarged view of corner B showing zippered connections 108 and 202. Zippered connection 202 is used to access the cavity containing the book while zippered connection 108 provides access to the interior of sleeping bag 100 as previously described. Referring back to FIG. 2, the cavity can be accessed by moving zipper 204 from point A, to point D, to point C, and then to point B. This opens three sides with the connection between A and B remaining closed and serving as the pivot for top cover member 102. The arrangement of the zipper allows an occupant of the sleeping bag to utilize the contents of the sleeping bag while situated in the sleeping bag. For example, FIG. 4 depicts the sleeping 100 after zippered connection 202 has been opened, revealing the cover of book 300. Utilizing this arrangement, the occupant can read the book while residing in the sleeping bag 100.

Figure 5:
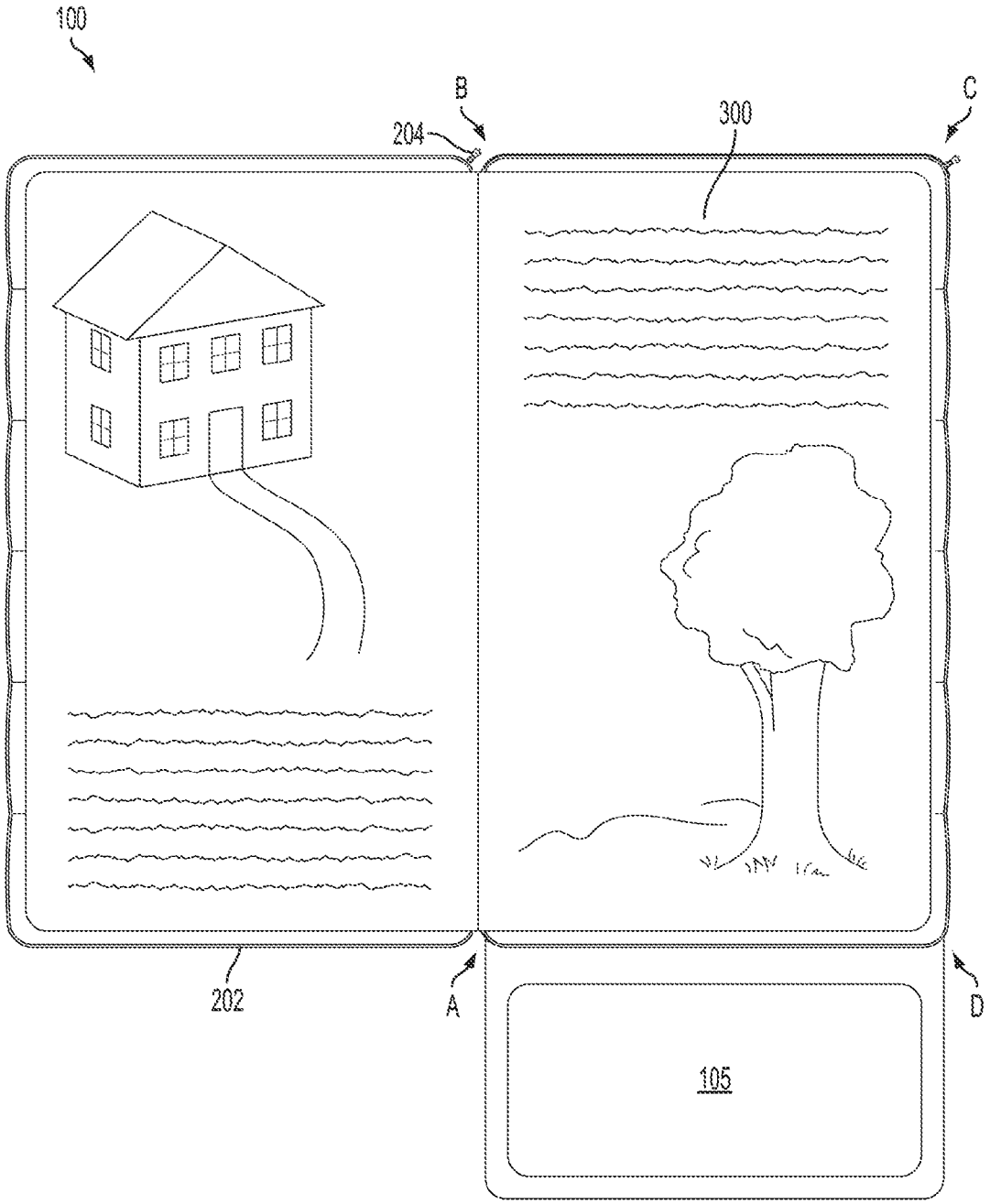
FIG. 5 depicts a view of the sleeping bag of FIG. 4 after the book has been opened.
Figure 6:
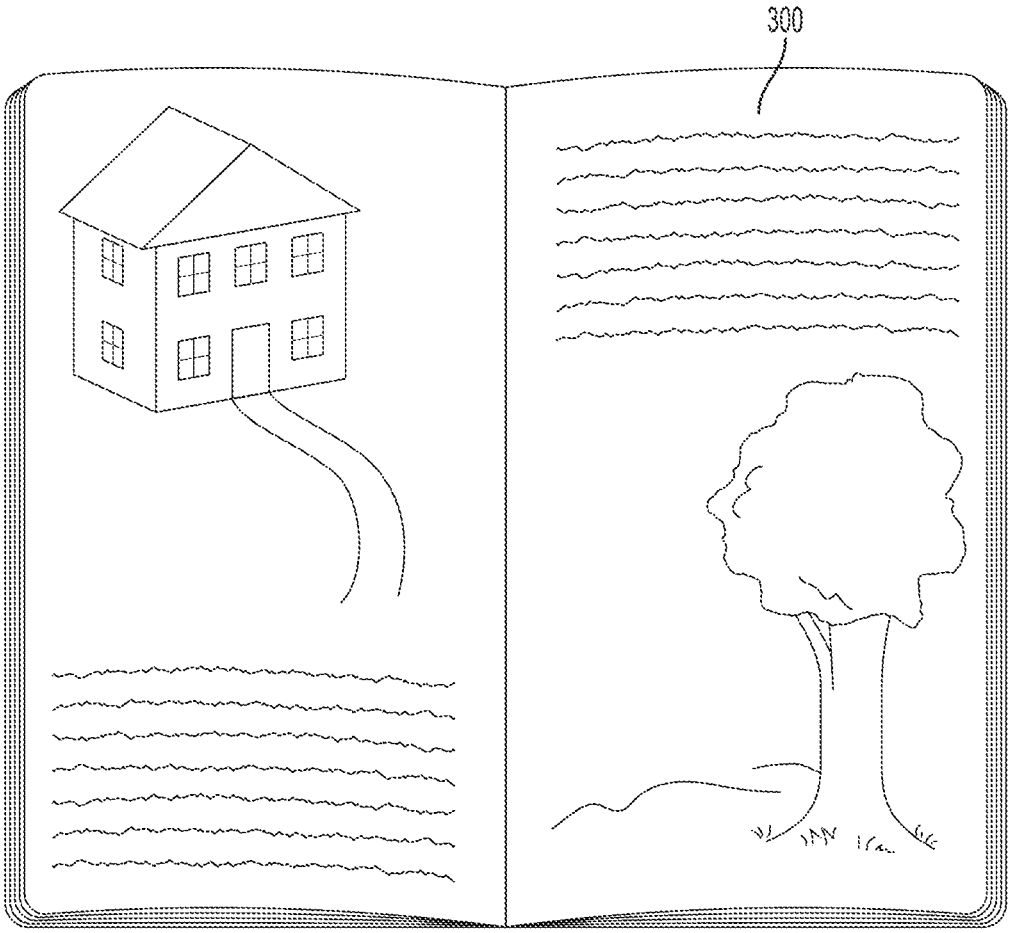
FIG. 6 depicts a view of the book of FIG. 4 after it has been removed from the sleeping bag and opened.

Book 300 can be made of any flexible material that aids in warmth such as cloth, plastic, or rubber. Book 300 can either be read in sleeping bag 100, as shown in FIG. 5, or removed via a removable connection and read alone as shown in FIG. 6.

Figure 7:
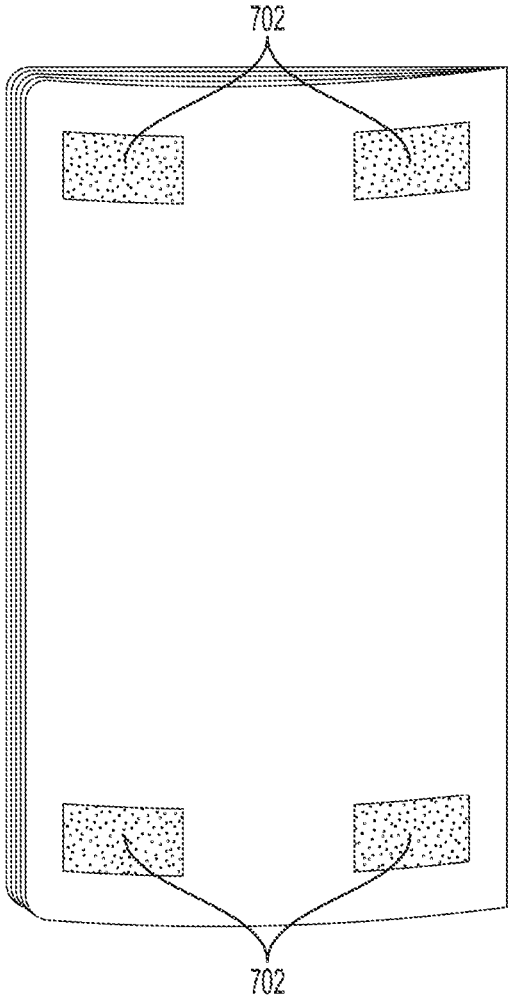
FIG. 7 depicts a bottom view of the book of FIG. 4 after it has been removed from the sleeping bag.
Figure 8:
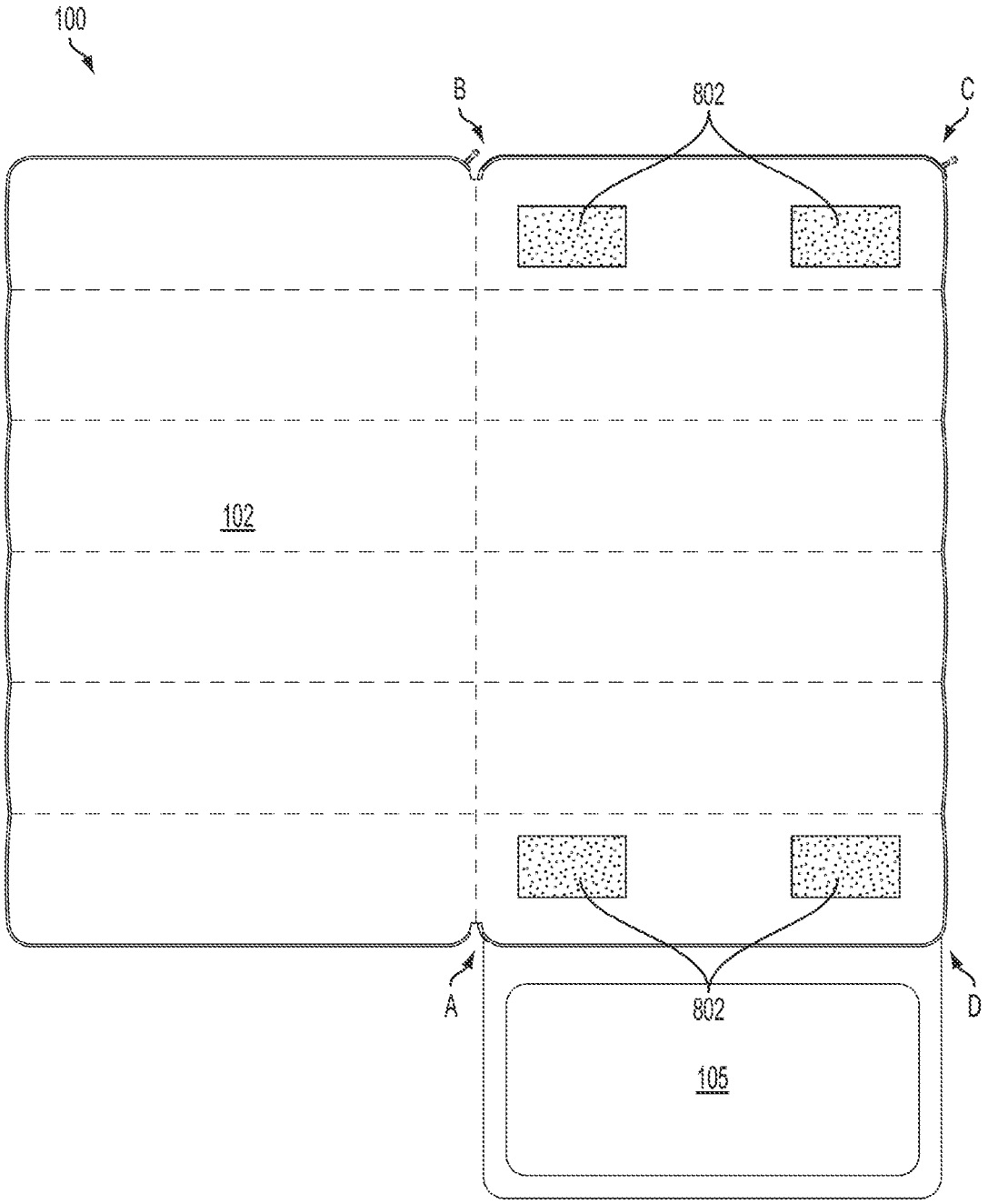
FIG. 8 depicts a view of the sleeping bag of FIG. 4 after the book has been removed from the sleeping bag.

FIG. 7 depicts the reverse side of book 300 having hook connectors 702 which mate with corresponding loop connectors 802 on sleeping bag 100 as shown in FIG. 8, thereby providing a removable connection between book 300 and sleeping bag 100. It should be appreciated that other types of releasable connections, such as snaps, may also be used.

Figure 9:
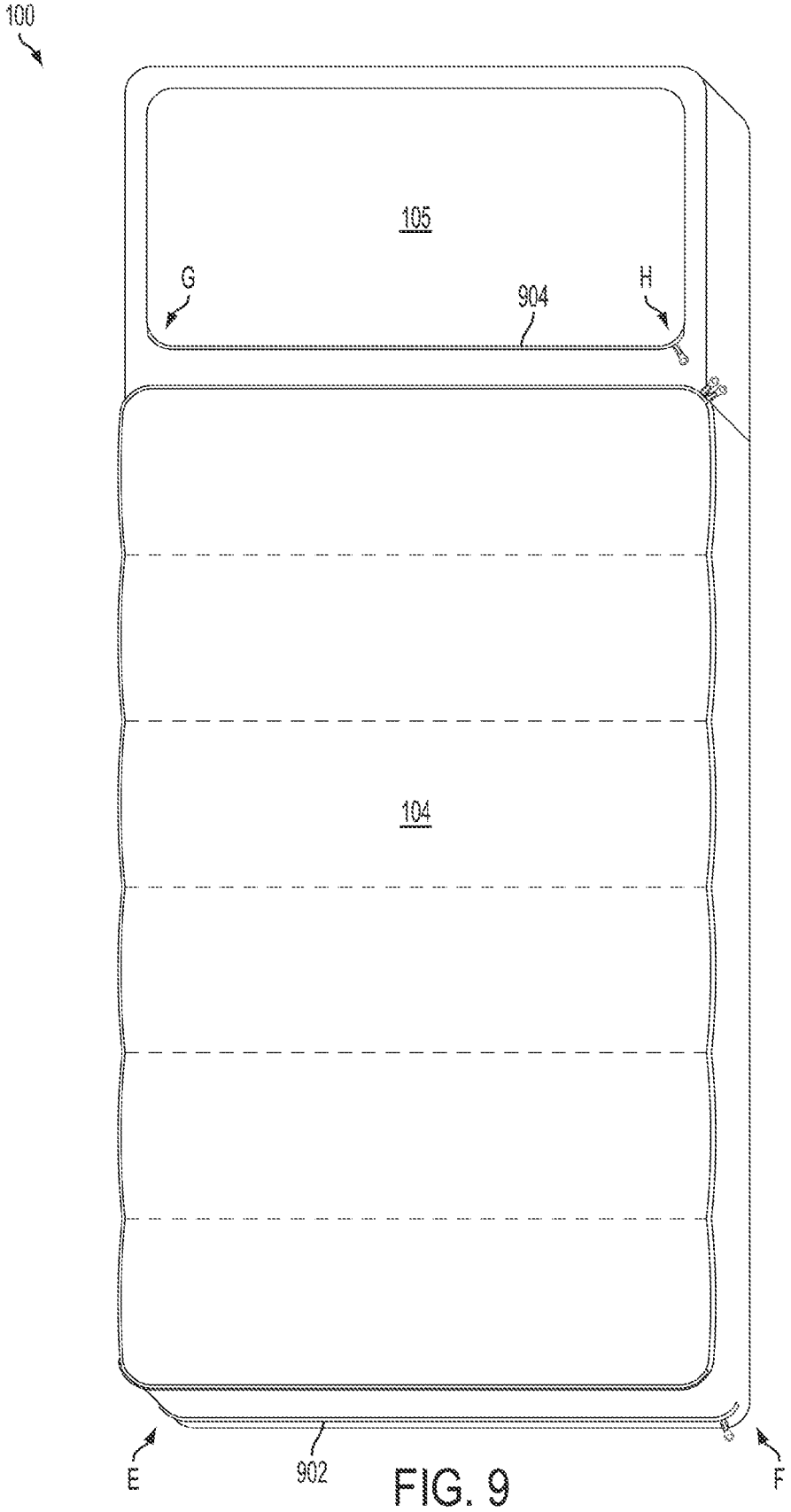
FIG. 9 depicts a bottom view of the sleeping bag of FIG. 1.

Sleeping bag 100 contains a base support of foam material located in bottom cover member 104 as shown in FIG. 9. An additional zippered connection 902 or the like can be provided from points E to F to allow insertion and removal of a foam insert into the base of sleeping bag 100. Likewise, to permit removal of pillow inserts, a zippered connection 904 can be provided in pillow member 105, for example from point G to H, on the sleeping bag 100, thereby allowing the pillow insert to be removed for washing or replacement purposes.

Figure 10:
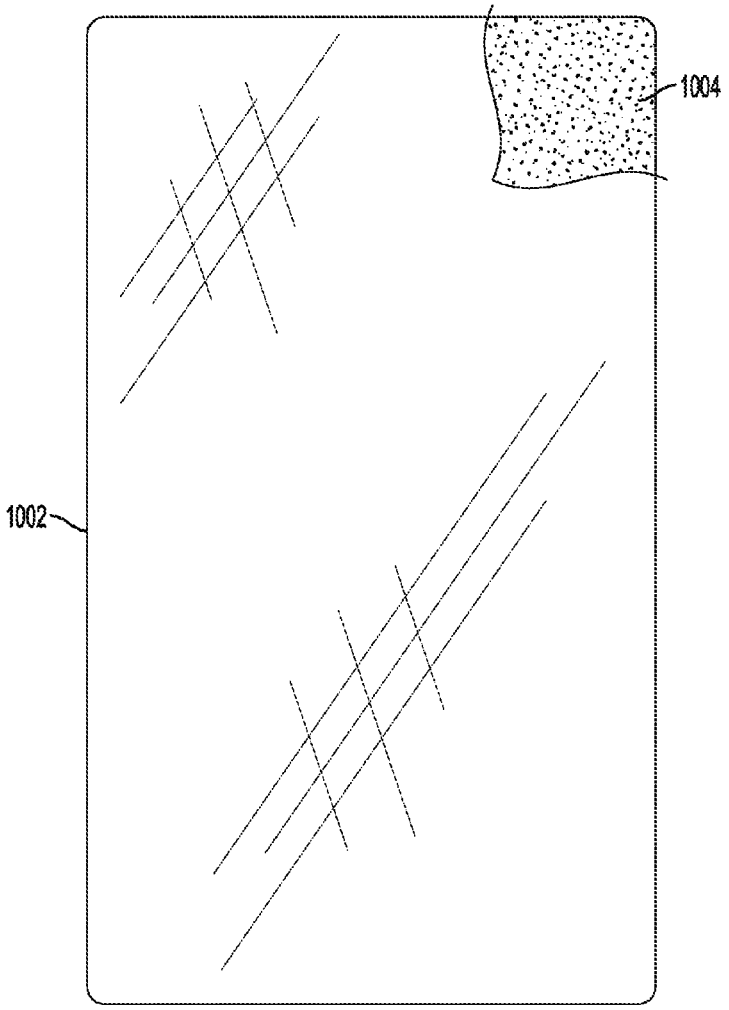
FIG. 10 depicts a top view of the foam body insert after it has been removed from the sleeping bag.

As shown in FIG. 10, there is a foam insert 1002 which is the base portion that is inserted through zippered connection 902 (FIG. 9) in the sleeping bag 100. Foam insert 1002 may optionally comprise waterproof cover 1004, thereby allowing the foam to be easily wiped clear without requiring it to be washed in a machine.

Figure 11:
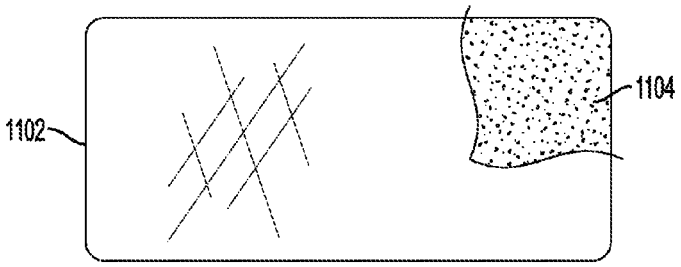
FIG. 11 depicts a top view of the pillow insert after it has been removed from the sleeping bag.

FIG. 11 similarly shows pillow insert 1102 which would be inserted zippered connection 904 (FIG. 9). Likewise, pillow insert 1102 may be made of a foam material having a waterproof cover 1104.

Figure 12:
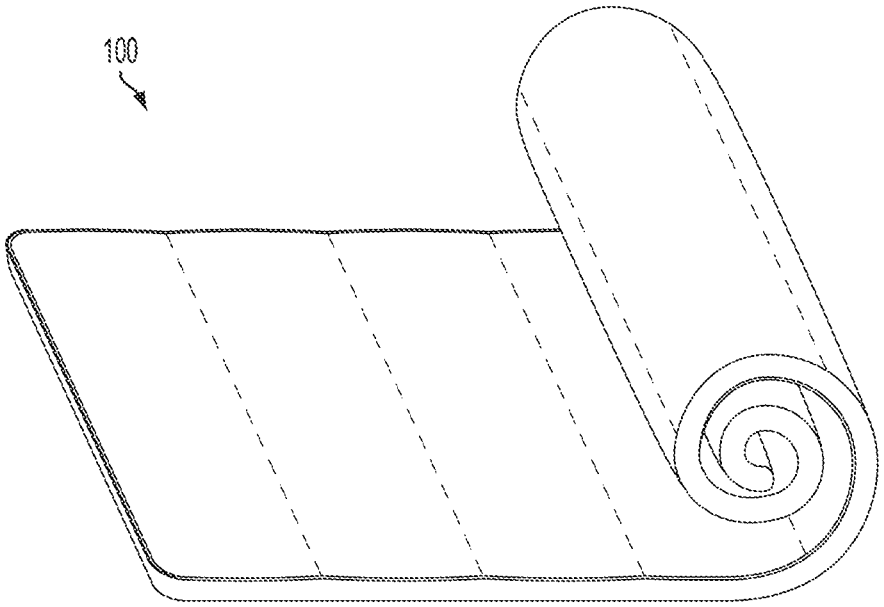
FIG. 12 depicts a view of the sleeping bag of FIG. 1 partially rolled up.
Figure 13:
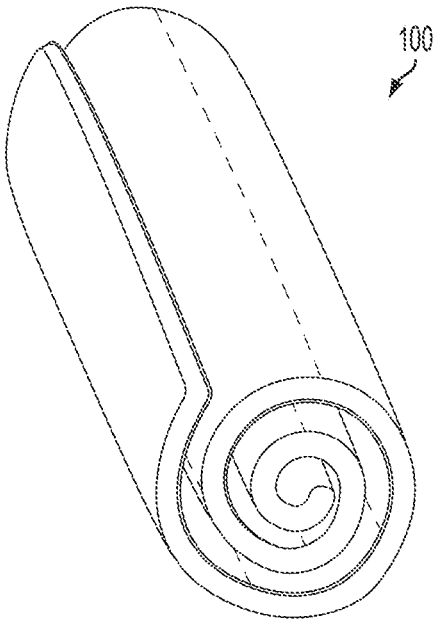
FIG. 13 depicts a view of the sleeping bag of FIG. 12 fully rolled up.
Figure 14:
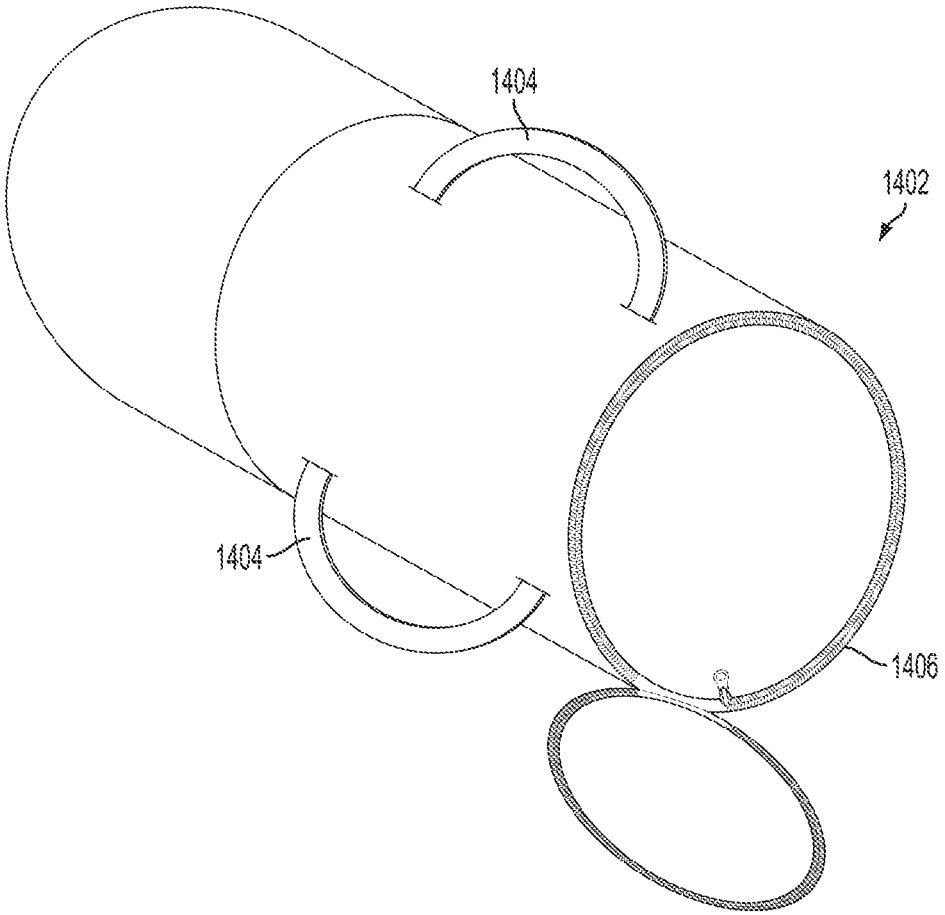
FIG. 14 depicts a carrying case for use with the sleeping bag of FIG. 1.

As with other sleeping bags, sleeping bag 100 can be rolled up as depicted in FIGS. 12 and 13. After sleeping bag 100 has been rolled up, it can be inserted into carrying member 1402 for easy transportation as depicted in FIG. 14. Carrying member 1402 contains shoulder straps 1404 so it can be used as a backpack and zippered connection 1406 for securing sleeping bag 100 within carrying member 1402.

Figure 15:
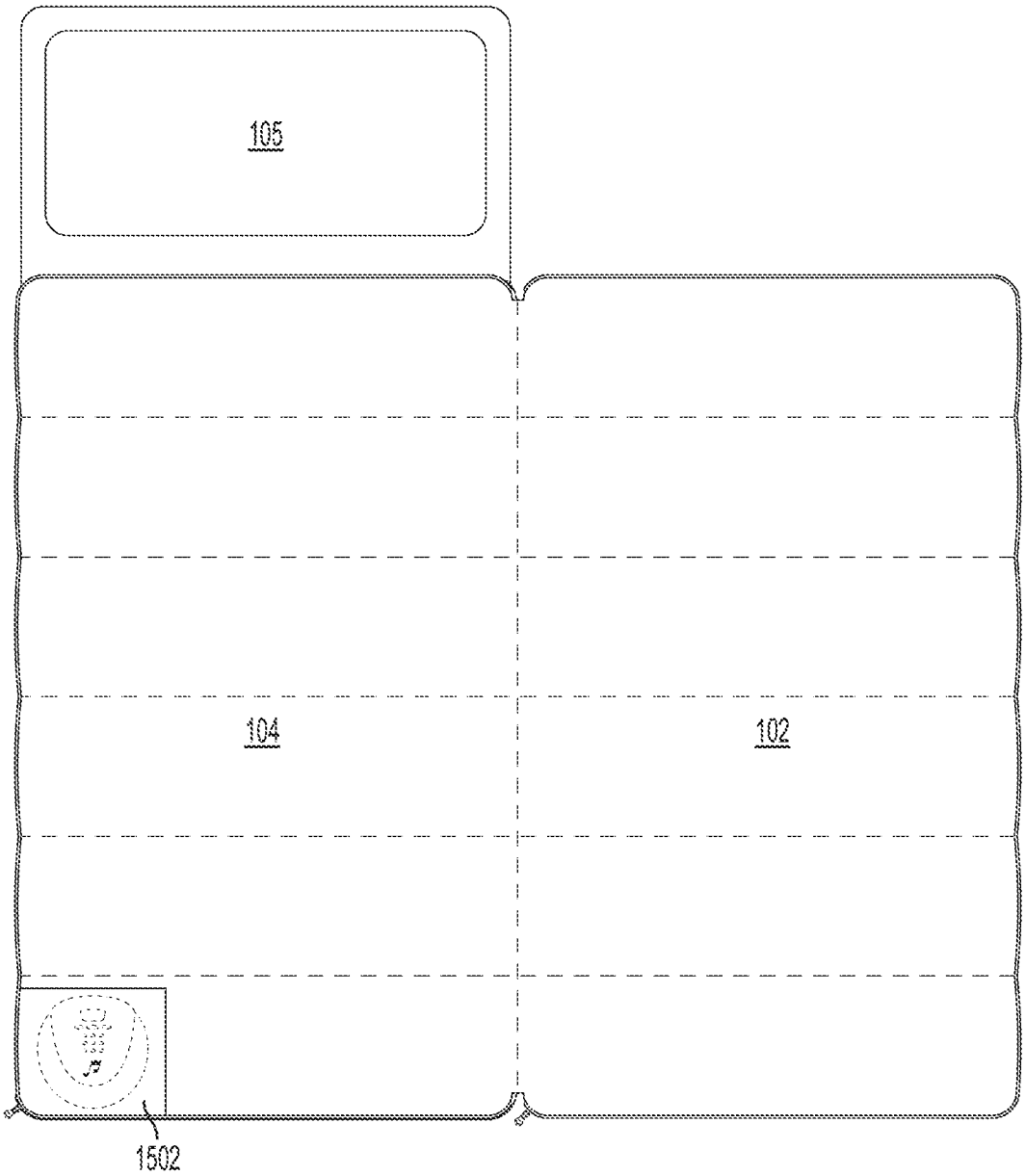
FIG. 15 depicts an alternate view of the sleeping bag of FIG. 4 wherein the cavity containing the book has a sealable pocket.

FIG. 15 depicts an alternate view of sleeping bag 100 in an opened position. As shown, sleeping bag 100 may optionally contain zippered pocket 1502 for a CD player and/or MP3 player having a recording of book 300 for younger children who do not read. Each time a different book 300 is placed in sleeping bag 100, the recording can be changed by replacing the CD in the CD player or downloading a new track to the MP3 player.

While the above description constitutes a plurality of embodiments of the present invention, it will be appreciated that the present invention is susceptible to further modification and change without departing from the fair meaning of the accompanying claims.

I claim:

1. A sleeping apparatus comprising:

a top cover member comprising four sides; wherein the top cover member further comprises:

a flap comprising four sides attached to a top surface of the top cover member, wherein the flap is pivotally attached along a first side to a first side of the top cover member, and is removably attached along a second side, a third side, and a fourth side to a second side, a third side, and a fourth side of the top cover member, respectively, by a continuous cooperative fastener element extending substantially the entire length of the second sides, the third sides, and the fourth sides; wherein when the second sides, the third sides, and the fourth sides are removably attached a cavity is formed; and wherein when the second sides, the third sides, and the fourth sides are removably detached, the flap forms an extended surface with the cavity being open; and an entertainment device located in the cavity that is removably attached to an inside of the cavity, wherein the entertainment device is able to be used by a user when the user's legs are positioned beneath the top cover member; and a bottom cover member attached to the top cover member along at least one common side forming a sleeping bag with an interior for receiving the user.

2. The sleeping apparatus of claim 1, wherein the entertainment device is removably attached to the inside of the cavity using a hook and loop connection.

3. The sleeping apparatus of claim 1, wherein the entertainment device is constructed from cloth, plastic or rubber.

4. The sleeping apparatus of claim 1, further comprising a carrying member configured to carry the sleeping apparatus.

5. The sleeping apparatus of claim 4, wherein the carrying member comprises shoulder straps.

6. The sleeping apparatus of claim 1, further comprising a pillow member attached to the bottom cover member.

7. The sleeping apparatus of claim 6, wherein the pillow member is removably attached to the bottom member cover.

8. The sleeping apparatus of claim 6, wherein the pillow member contains a removable foam insert.

9. The sleeping apparatus of claim 1, wherein the bottom cover member contains a removable foam insert.

10. The sleeping apparatus of claim 9, wherein the removable foam insert is waterproof.

11. The sleeping apparatus of claim 1, wherein the top cover member is attached to the bottom cover member on two sides using a fastening means.

12. The sleeping apparatus of claim 1, wherein the top cover member and the bottom cover member are formed from a single member, wherein the single member is configured to form the top cover member and the bottom cover member by folding the single member in half such that one half of the single member defines the top cover member and the remaining half of the single member defines the bottom cover member.

13. The sleeping apparatus of claim 1, wherein the entertainment device is a book.

14. The sleeping apparatus of claim 13, wherein when the flap is open along three sides the book is openable.

15. The sleeping apparatus of claim 13, wherein when the book is opened and removably attached to the inside of the cavity, the book spans at least a portion of the top cover member and the extended surface.

16. The sleeping apparatus of claim 1, wherein the sleeping apparatus further comprises a sealable pocket.

17. The sleeping apparatus of claim 16, wherein the sealable pocket contains an MP3 player or a CD player.

18. The sleeping apparatus of claim 16, wherein the sealable pocket is sealable by a zipper.

* * * * *